US007293827B2

(12) United States Patent
Schrader

(10) Patent No.: US 7,293,827 B2
(45) Date of Patent: Nov. 13, 2007

(54) AMBULATORY WALKER

(76) Inventor: Joseph F. Schrader, 22 Pearl St., New Hartford, NY (US) 13413

( * ) Notice: Subject to any disclaimer, the term of this patent is extended or adjusted under 35 U.S.C. 154(b) by 0 days.

(21) Appl. No.: 11/504,284

(22) Filed: Aug. 15, 2006

(65) Prior Publication Data

US 2007/0044826 A1 Mar. 1, 2007

Related U.S. Application Data

(60) Provisional application No. 60/708,026, filed on Aug. 15, 2005.

(51) Int. Cl.
*A61H 3/00* (2006.01)

(52) U.S. Cl. ..... 297/195.11; 297/183.4; 135/66

(58) Field of Classification Search ..... 297/5, 297/6, 195.11, 183.4; 135/65, 66
See application file for complete search history.

(56) References Cited

U.S. PATENT DOCUMENTS 4,274,430 A * 6/1981 Schaaf et al. ..... 135/65 X
4,892,352 A * 1/1990 Haywood ..... 297/195.11
5,385,163 A * 1/1995 Fairchild ..... 135/65
5,524,658 A 6/1996 Schrader
6,033,016 A * 3/2000 Haywood ..... 297/195.11 X
6,959,716 B1 11/2005 Schrader

* cited by examiner

*Primary Examiner*—Anthony D. Barfield
(74) *Attorney, Agent, or Firm*—Marjama Muldoon Blasiak & Sullivan LLP

(57) ABSTRACT

An ergonomically designed ambulatory walking device comprised of a bicycle seat supported by an offset seat post that can be used for both right and left injuries. Different handlebar configurations can move the user's hands any number of different positions laterally to the right or left, higher and lower in relationship to the seat and closer and farther from the pelvis. Different frame sizes and height and seat to hand spread make it possible to fine tune a person's balance by selecting standardized parts. The dispensing method allows for verification of doctor's orders and the procedure for selecting parts by a trained individual allows for proper body positioning of the user. The new and simplified frame design, along with its various components and stabilizers, help persons needing more assistance. The method for adjusting and dispensing these devices uses computer software and the Internet or a fax machine, making it possible to deliver the correct walker to an individual virtually anywhere in the world.

21 Claims, 8 Drawing Sheets

34
39
41
66
86L
31T
82
84
12
23
25
2A
2B
33
90
86R
82R
34A
64
86L
94
88
94
84
82

AMBULATORY WALKER

BACKGROUND OF THE INVENTION

The present invention relates generally to a seated ambulatory device in a simple manufacturing design with few frame parts, and a method and tools for adjustment, comprised of a number of interchangeable components. The device can be adjusted for greater balance for a wider and diverse group of patients. Using the Internet can greatly improve ordering and distribution of properly sized components, thereby helping to simplify assembly and increase strength of the device by using the most desirable parts while reducing cost.

When a person loses a lower limb or has had a serious leg injury, there is a time when healing of the leg or stump makes it impossible for the individual to ambulate. So technically, wheelchairs and traditional walkers are used for the rehab process. In many cases, this is ineffective because of injuries to the shoulders, hands suffering from carpal tunnel, bursitis in the shoulder or torn rotator cuffs of the shoulder.

Medical devices have been developed to facilitate ambulating. U.S. Pat. No. 5,524,658 issued Jun. 11, 1999 to Joseph F. Schrader and entitled *Sit to Stand Hinged Seat Walker with Pull-up Handles* also employs a vertical upright post with a planar seat that locks in a vertical position.

U.S. Pat. No. 6,959,716 B1, issued Nov. 1, 2005 to Joseph F. Schrader and entitled *Ergonomically Designed Walker* also has an offset seat post and adjustable handle grip bars.

These devices fall short in simplification. The frames are dependent on the specific right or left frames being used. The potential of an incorrect frame being selected for a patient is eliminated with the present method for measuring and dispensing. Adjustment of the prior devices often requires custom made components to achieve a balancing point that is comfortable. The movement of the individual's hands is limited without the ability to move them in lateral directions or to vary their height in relationship to the seat. With the improved ergonomic handles, handlebars and the dispensing system of the present invention, the therapist or prosthetist can give the user a greater degree of control over the position of the stabilization foot in a much shorter period of time with verifiability that the adjustments were made in accordance with the doctor's orders.

It is the object of this new and improved invention to better position the upper body and hands with new handlebar components, making proper placement of a person's core, forward and aft and laterally, not possible with prior inventions. The more simplified frame has an offset seat post component that is adjustable both to the right or left side, not possible with prior frames. A new stabilization system gives greater stability for people who have balance difficulties, making it possible for very accurate body positioning to achieve balance for these individuals, using standardized parts, making adjusting far simpler and faster, and saving time and money.

SUMMARY OF THE INVENTION

The present invention relates generally to a seated walking ambulatory device that has a much simpler manufacturing design with fewer frame parts and a method and tools for adjustment comprised of a number of interchangeable components that can be adjusted for greater balance for a wider and diverse group of patients. Using this new apparatus and the method using the Internet can greatly improve ordering and distribution of properly sized components, helping to simplify and, while using the most desirable parts, increasing strength and reducing cost.

DETAILED DESCRIPTION OF THE INVENTION

Figure 1:
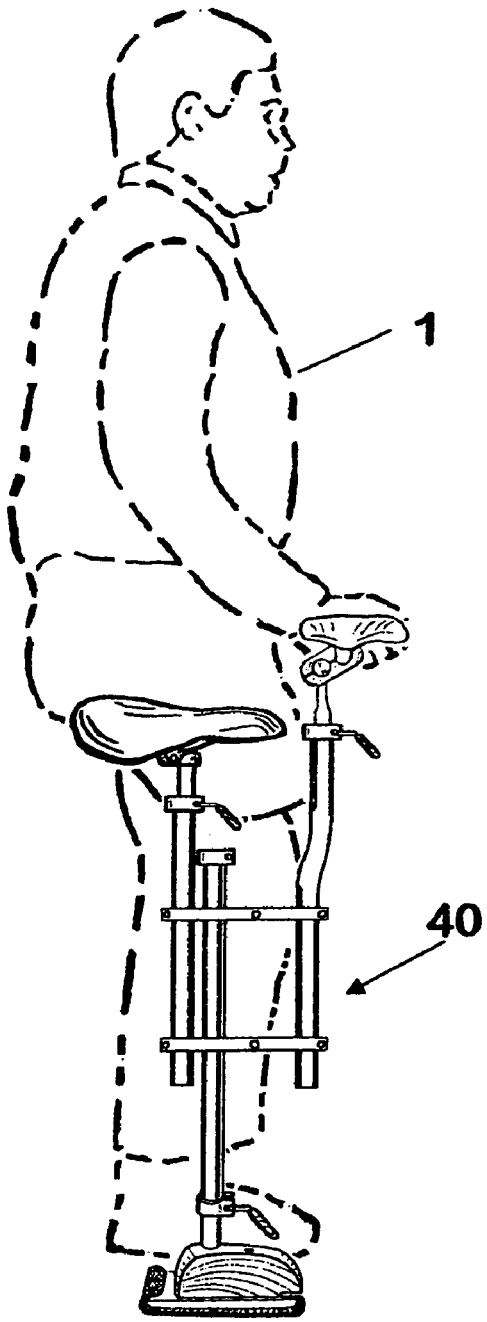
FIGS. 1 and 2 are perspective views of two embodiments of the present invention as used by a person as shown in phantom.

Referring to the drawings in detail, FIG. 1 shows a phantom amputee sitting on one embodiment of the inventive walker 40 designed for a right leg amputee, with the device being properly adjusted for height of the seat, height of the hands and the distance of the hands from the pelvis to achieve proper balance and posture.

Figure 2:
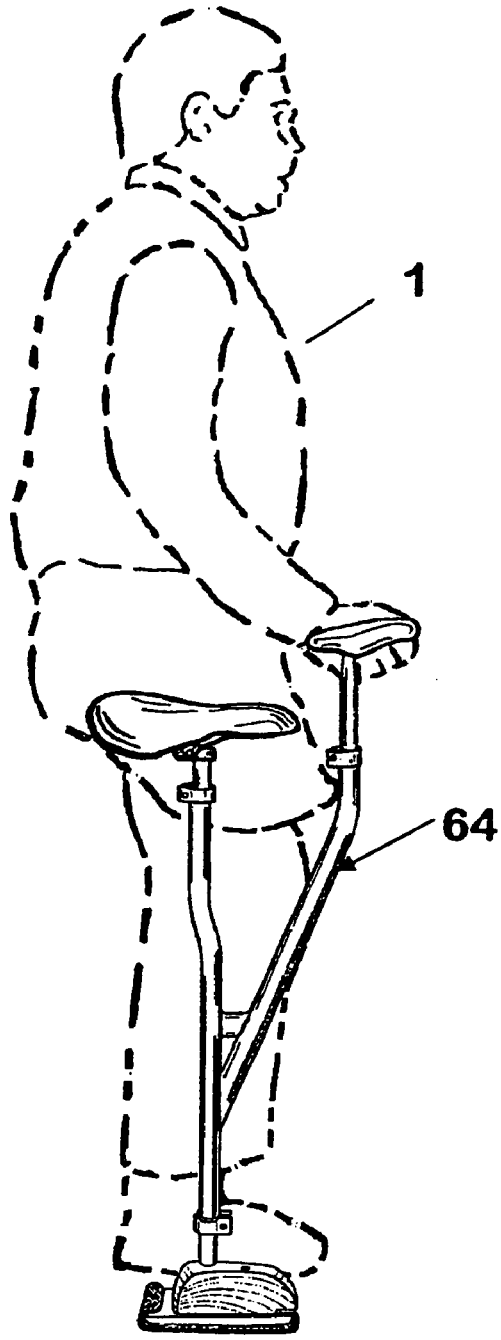

FIG. 2 shows, the same phantom amputee as sitting on a right injured limb offset frame assembly 64 in accordance with another embodiment of the invention. The user is in a natural comfortable stance with little curvature of the spine.

Figure 3:
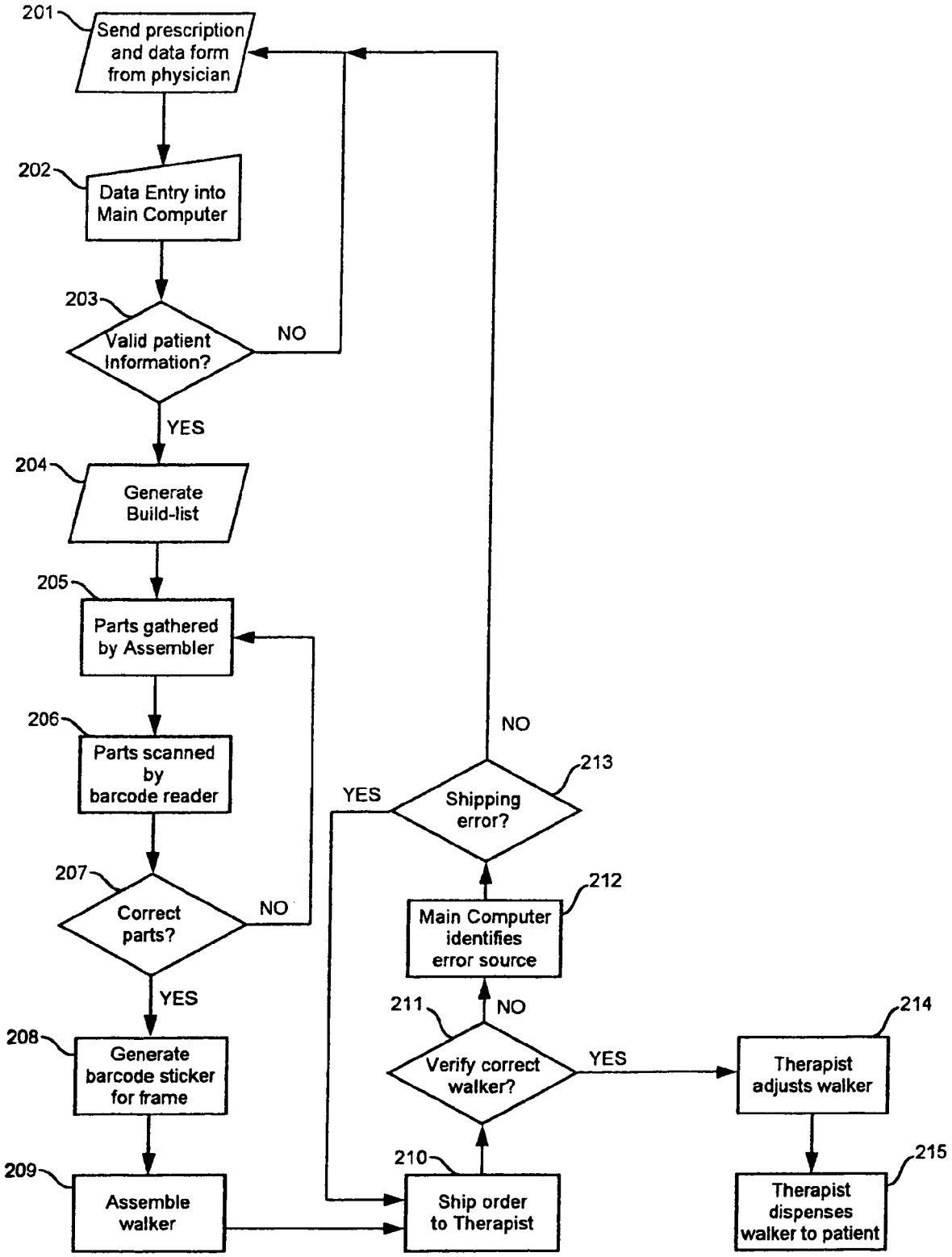
FIG. 3 is a flow diagram illustrating a method for dispensing the present invention.

FIG. 3 is a flow chart showing a method for dispensing the walker 64 by verifying the correct walker for the injury. It is a check and balance system for the physician, therapist and the dispensing facility.

In block 201, a patient is evaluated by a physician as a suitable candidate for the device. The physician writes a prescription to that effect and fills out sections of a template form provided by the supplier of the device.

The patient's personal and contact information (name, address, etc.), as well as the type of injury or disease, and leg involved are noted and sent to the main data processing facility via email, fax or US Postal Service.

Remaining fields are later filled as determined by the therapist to include the patient's weight and inseam length. Other fields are devoted to measurements and walker components consisting of foot type, frame type, seat type, bar end type, seat post size, handle height, floor-to-seat height, and frame offset.

In block 202, the physician form information is entered into a database at a data processing center.

In block 203, form fields are validated for appropriate input type and are cross-referenced with an ongoing, updated database built from studies and relevant content to see if certain criteria are met. If the patient data is invalid or specific conditions are not met, the form is rejected and returned to the physician for correction or reconsideration.

In block 204, the software approves the order for assembly, selecting barcoded components from the database per the physician's specifications. This "build-list" is generated and sent by the main computer to another local or remote computer at a warehouse/storage facility.

In block 205, primary and specific parts are gathered at the facility.

In block 206, each part is scanned, comparing its barcode to those on the "build-list."

In block 207, if a conflict occurs, the warehouse is notified that incorrect parts were shipped.

In block 208, positive verification results in a "variation number", generated as a barcode sticker for attachment to the walker frame. This number is unique to the individual user. The variation number is transmitted to the main computer for inclusion in a database and patient record.

In block 209, the device is assembled and checked by a quality control specialist. Scans of unique barcode labels and the variation number are performed. The latter number is also duplicated for attachment to the walker's shipping box. An address label is printed for the shipping box which is then sealed.

In block 210, the walker is sent via a transportation carrier to a therapist or technician.

In block 211, the therapist scans the walker's frame barcode. Software validates if the correct device was received.

In block 212, the computer system identifies whether a shipping or prescription error occurred.

In block 213, the applicable source is notified.

In block 214, if the appropriate walker was received, the therapist adjusts components, fitting the device to the patient's needs. He records measurements in the related fields of the template form for transmission and entry into the main database.

In block 215, the therapist trains the patient in the proper use of the walker device, and upon successful completion of that task, certifies the patient and dispenses the walker to him/her.

Figure 4:
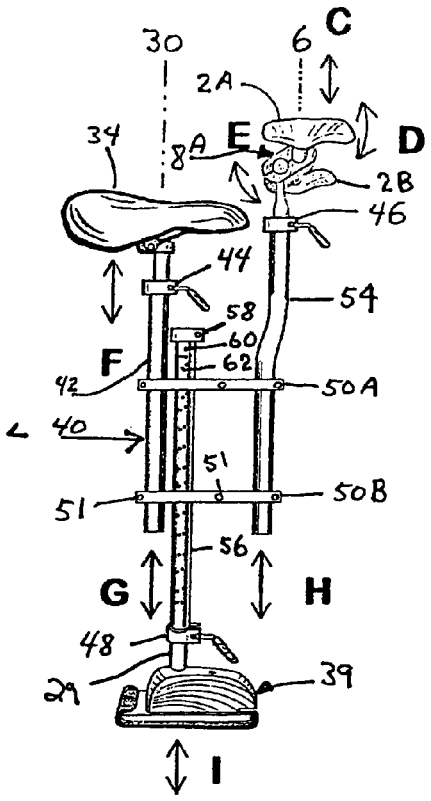
FIG. 4 is a right side view of one embodiment of the present invention.

FIG. 4 illustrates one embodiment of the walker device 40 that shows the up and down movement of the foot assembly 39, the saddle post tube 42 and the handlebar T 12. The arrows at C, D and E show the ability to adjust the position of the handlebar 6 by loosening and tightening handlebar adjuster clamp cap screws 9. The arrow at F shows the ability to vertically position the saddle 34 by loosening and tightening the quick release saddle post clamp 44. The arrows at G and H show the vertical adjustability of the walker measuring simulator 40 by loosening and tightening simulator adjuster clamp cap screw 51 and the simulator upper 50A and lower 50B adjuster clamp.

The arrow at I shows the adjustability of the foot assembly 39 by loosening and tightening the foot assembly quick release clamp 48. The foot assembly receiver tube 56 has a receiver tube spring retainer 60 being held in position by the foot assembly receiver tube clamp 58. The receiver tube spring 62 pushes against the receiver tube spring retainer 60 and the foot post 29.

Figure 5:
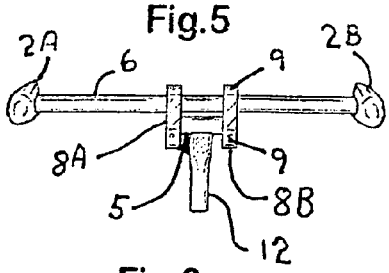

FIG. 5 is a view of the multi-adjustable T bar assembly 5 that allows for changeable handlebars 6 of varying lengths for changing hand locations and separation. The handlebar T 12 accepts varying lengths of the handlebar right adjuster clamp 8A and handlebar left adjuster clamp 8B which allows handlebar 6 to be moved horizontally.

Figure 6:
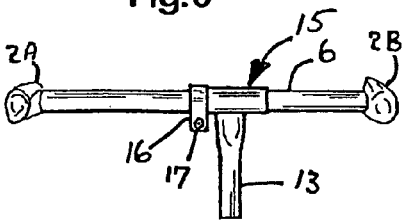

FIG. 6 is a view of a telescopic version of the handlebar assembly 15 comprised of the handlebar 6 which can slide horizontally and be held in position by the handlebar T support tube clamp 16 and clamp cap screw 17. It should be recognized that both the offset positions of the two ends 2A and 2B, as well as their separation distance can be selectively varied. T bar handle right end 2A and left end 2B can be tilted or rotated to a comfortable position. The vertical handlebar support tube 13 may vary in length.

Figure 7:
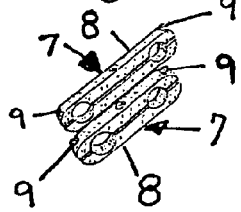
FIGS. 5-8 are various views of the handlebar portion of the present invention, indicating the adjustments that can be made thereto.

FIG. 7 is an enlarged view of the handlebar adjuster clamp assembly 7 shown in FIG. 5. There are two sizes shown, with handle bar adjuster clamp 8 and handlebar adjuster clamp cap screw 9. They can be varied in size to allow the walker to be specifically adjusted for hand placement for proper upper body positioning of a particular user. For any one user the length of the assemblies are the same.

Figure 8:
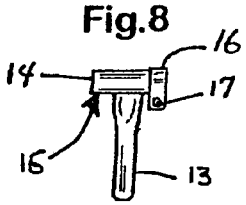

FIG. 8 shows a sliding handlebar assembly 15 which has a handlebar support tube 14 positioned by the handlebar T support tube 16 and the clamp cap screw 17. It should be recognized that the features shown in FIGS. 5-8 are equally applicable to the embodiment shown in FIG. 9.

Figure 9:
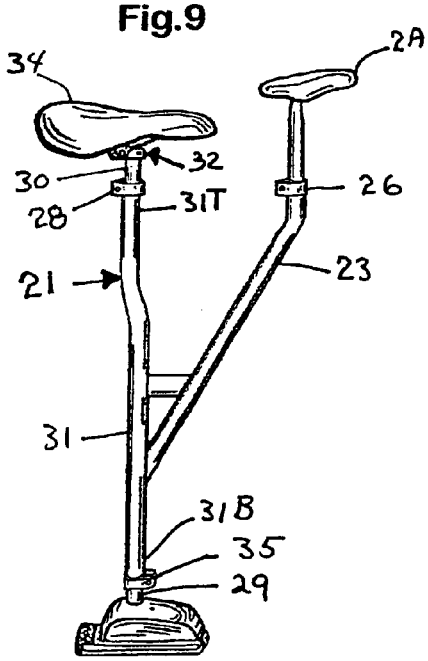
FIG. 9 is a right side view of a preferred embodiment of the present invention.

FIG. 9 is a view of a preferred embodiment of the walker assembly 21. The saddle 34 is attached to saddle post 30 by saddle clamp assembly 32. The saddle post clamp 28 attaches to the offset support tube top 31T. Foot post clamp 35 is attached to offset support tube bottom 31B which retains foot post 29.

Figure 10:
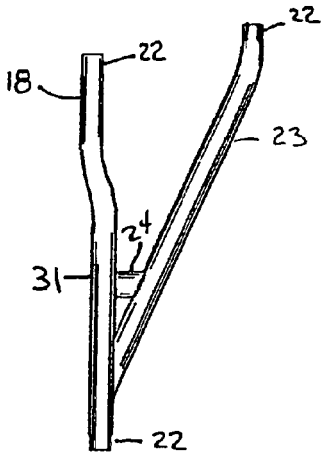
FIGS. 10 and 11 are indicative of various sizes of the frame thereof.

FIG. 10 shows a short walker frame 18 with upper T bar support tube 23 welded to offset support tube 31 and reinforced by frame gusset 24.

Figure 11:
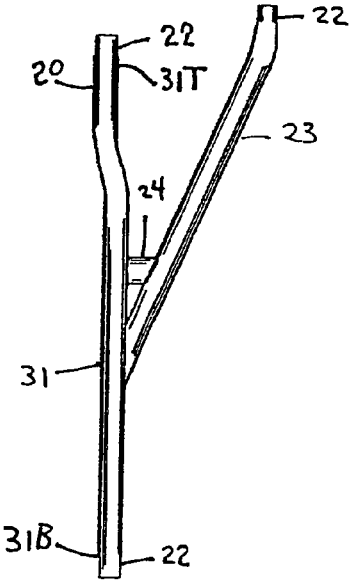

FIG. 11 shows a longer walker frame 20 which is identical in components to FIG. 10 and varying only in size.

Figure 12:
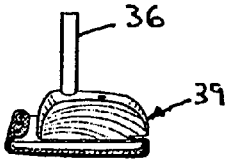
FIGS. 12 and 13 are alternative designs of the foot portion thereof.

FIG. 12 shows the foot assembly 39 with a short foot post 36 which is attached to offset support tube 31 as shown in FIG. 9.

Figure 13:
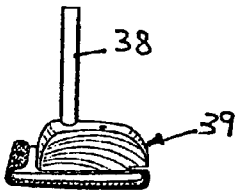

FIG. 13 shows the foot assembly 39 with a longer foot post 38 to allow for greater versatility of the walker assembly 21 as shown in FIG. 9.

Figure 14:
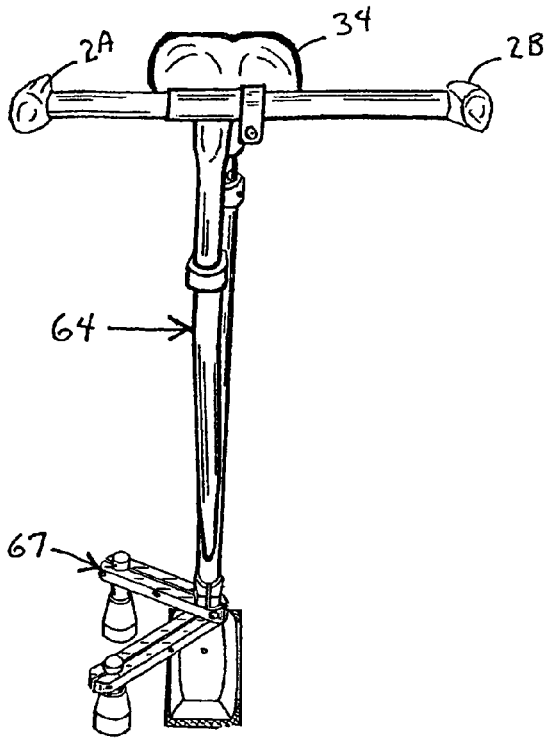
FIGS. 14 and 15 show the relationship between the adjustable handles and the stabilizer portion thereof.

FIG. 14 shows a right injured limb offset frame assembly 64 with right stabilizer assembly 67 added for additional stability for the user. The T bar handle right end 2A and left end 2B are offset to position a person's upper body more over the residual (i.e. the remaining) limb.

Figure 15:
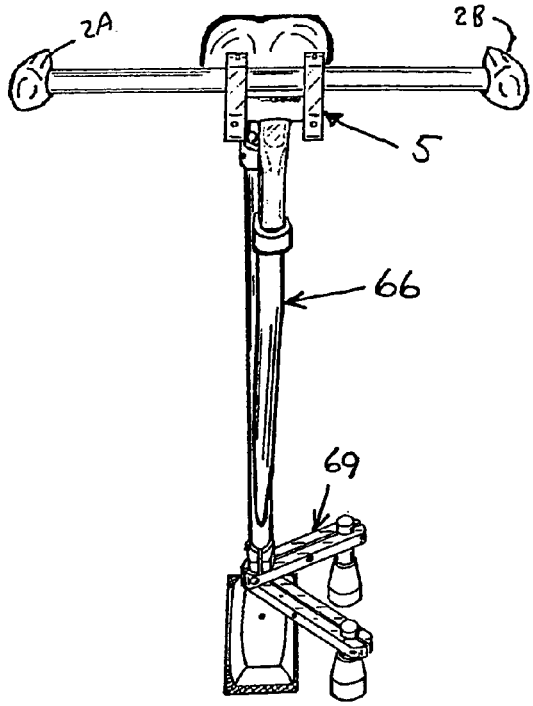

FIG. 15 shows a left injured limb offset frame assembly 66 with a left stabilizer assembly 69 and a multi-adjustable tube bar assembly 5 as shown in FIG. 5. The T bar handle right end 2A and left end 2B are more centered than in FIG. 14. In this regard, it should be recognized that the position of the handlebars will be selectively varied to best fit the needs of the user.

Figure 16:
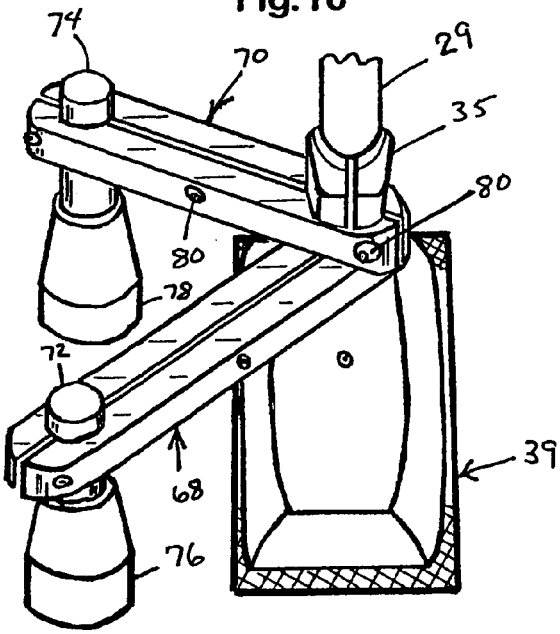
FIGS. 16 and 17 show variations of the stabilizer portion thereof.

FIG. 16 is a detailed view of the right stabilizer assembly 67 shown in FIG. 14. It is comprised of a rear stabilizer post 74 that is held in place by a rear stabilizer adjuster clamp assembly 70 which also clamps to the foot post 29 below the foot post clamp 35 and above the front stabilizer adjuster clamp assembly 68, held in place by the stabilizer cap screw 80. The rear stabilizer post 74 inserts into the rear stabilizer post tip 78. Similarly, the front stabilizer post 72 inserts into front stabilizer post tip 76.

Figure 17:
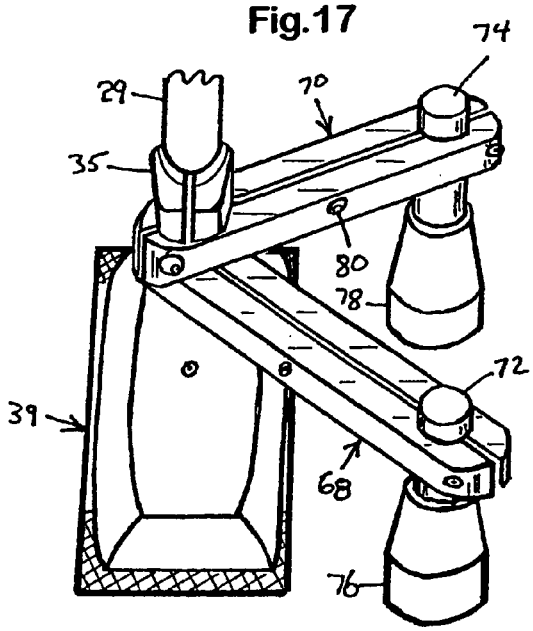

FIG. 17 is identical to FIG. 16 but the front stabilizer adjuster clamp assembly 68 and rear stabilizer adjuster clamp assembly 70 are positioned to the left of foot assembly 39 instead of to the right as shown in FIG. 16.

Figures 18, 19, 20, 21:
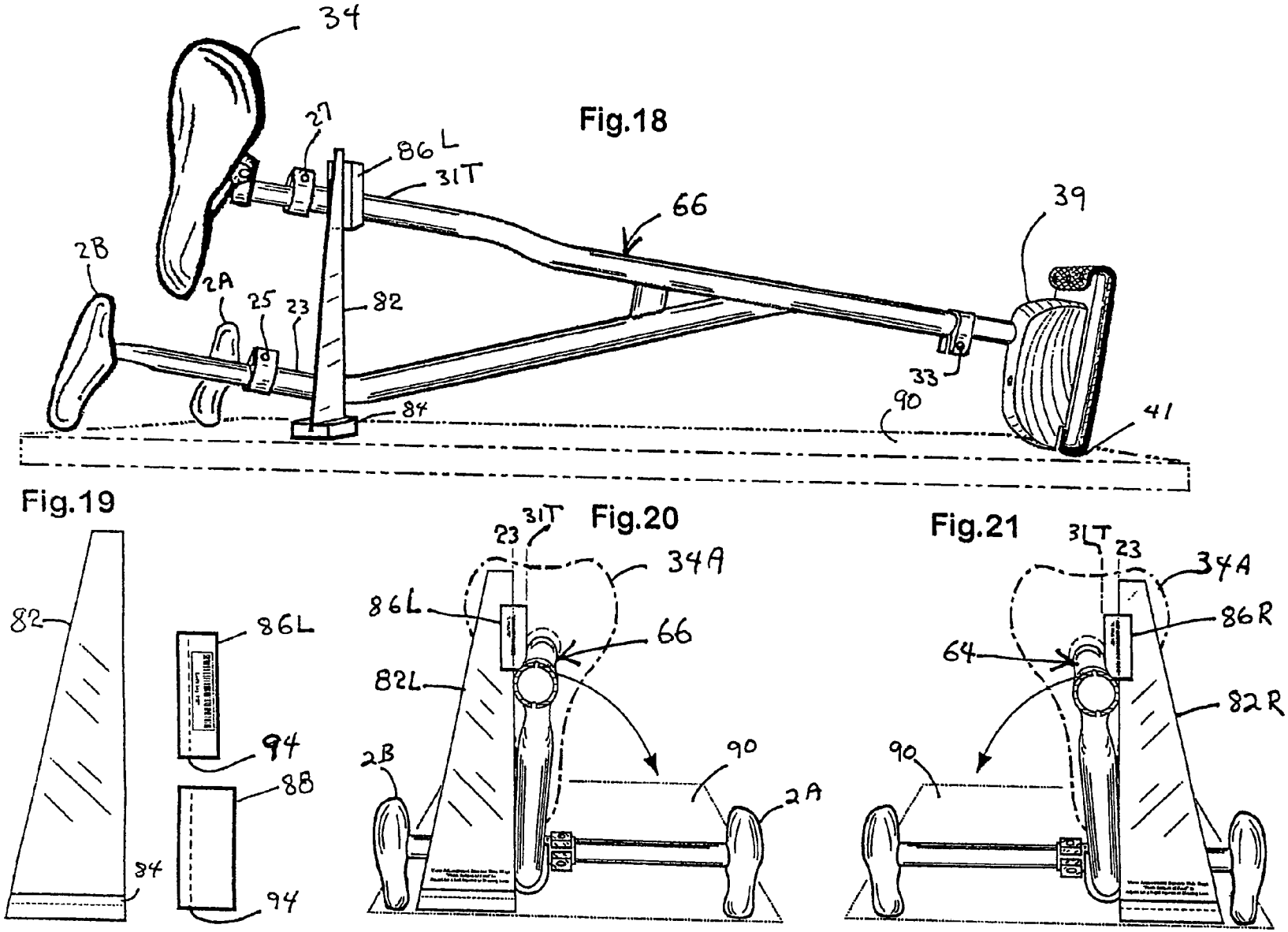
FIGS. 18-21 show various views indicating the adjustment of the device for particular users.

FIG. 18 shows a left injured limb offset frame assembly 66 being adjusted using an acrylic 90 degree adjustment guide 82. Frame 66 is laid on a flat surface 90 with the T bar handle right end 2A and left end 2B and the front of foot assembly 41 resting on a flat surface 90. Handlebar T clamp assembly cap screw 25, saddle post clamp cap screw 27 and foot post clamp screw 33 are loosened. Small bar coded adjustment bar left 86L is positioned between the offset support tube top 31T and the adjustment guide 82 at its uppermost end. The groove in block 94 allows adjustment spacer 86 or 88 to press onto 90 degree adjustment guide 82. The adjustment guide 82 also rests against upper T bar support tube 23. After proper adjustments to the frame assembly 66 are made, handlebar T clamp assembly cap screw 25, saddle post clamp cap screw 27 and foot post clamp are retightened.

FIG. 19 is an enlarged view of acrylic 90 degree adjustment guide 82, adjustment guide base 84, small bar coded adjustment spacer 86 and large bar coded adjustment spacer 88 as shown being used in FIG. 18 for adjustment of the frame assembly 66. While the adjustment guide 82 is standard for all users, the small bar coded adjustment bar 86 and the spacer 88 are specific to the needs of the user and are used in providing any desired offset between the tube top 31T and the tube bottom 31B as shown in FIGS. 20-22.

FIG. 20 is a bottom view of a left injured offset frame 66 with the foot assembly 39 removed for a clearer view. It shows T bar handle right end 2A and left end 2B resting on flat surface 90. The phantom saddle 34A is positioned perpendicular to the flat surface with the front of saddle 34A pointing straight down toward the flat surface 90. The small bar coded adjustment spacer 86L is resting against the offset support tube top 31 T on the left side as shown and left acrylic 90 degree adjustment guide 82L is resting against the upper T bar support tube 23.

FIG. 21 shows a right injured limb offset frame assembly 64 being adjusted using the same procedure outlined in FIG. 20.

Figure 22:
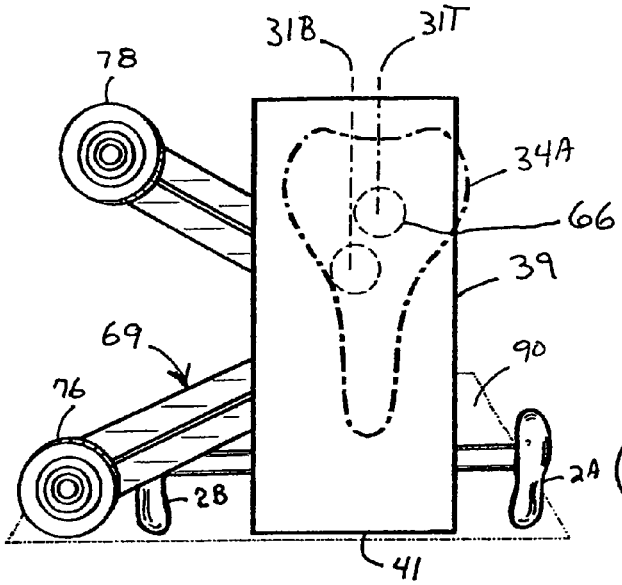
FIGS. 22-25 show various adjusted positions of the stabilizer for particular patient needs.

FIG. 22 is a bottom view of a left injured limb offset frame assembly 66 looking from the bottom of the foot assembly 39. T bar handle right end 2A and T bar handle left end 2B are resting on flat surface 90 as is front stabilizer post tip 76. The offset support tube top 31T and bottom 31B are shown in an offset position.

Figure 23:
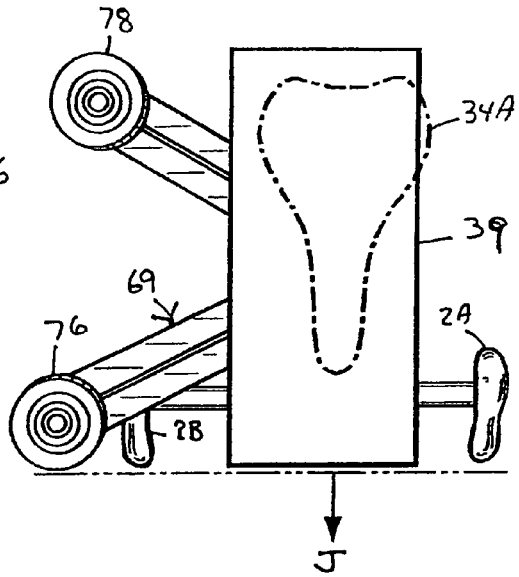

FIG. 23 is a bottom view of left injured limb offset frame assembly 66 looking from the bottom of foot assembly 39. The arrow at J shows the direction of the assembly 66 at the end of the step.

Figure 24:
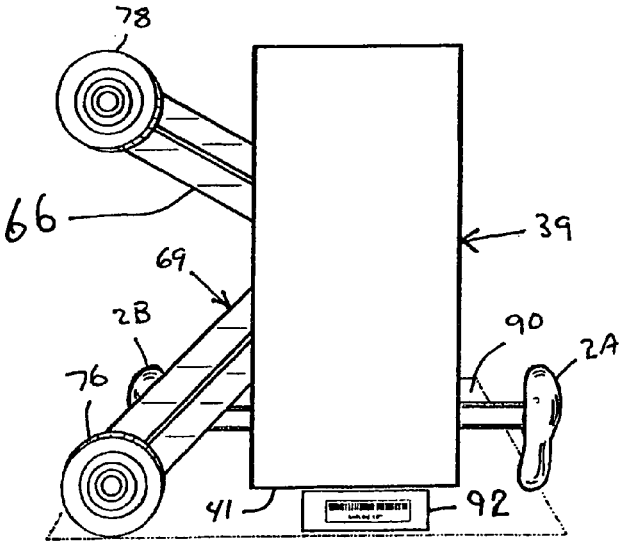

FIG. 24 is a bottom view of left injured limb offset frame assembly 66 looking from the bottom of foot assembly 39. The front of foot assembly 42 is resting on an incrementally sized bar coded adjustment block 92. Front stabilizer post tip 76 is also resting on flat surface 90. The use of the adjustment block 92 causes the front stabilizer post tip 76 to be positioned forward of the front of the foot assembly 41. This an important feature for purposes of shifting the weight of a user as will be seen in FIG. 25.

Figure 25:
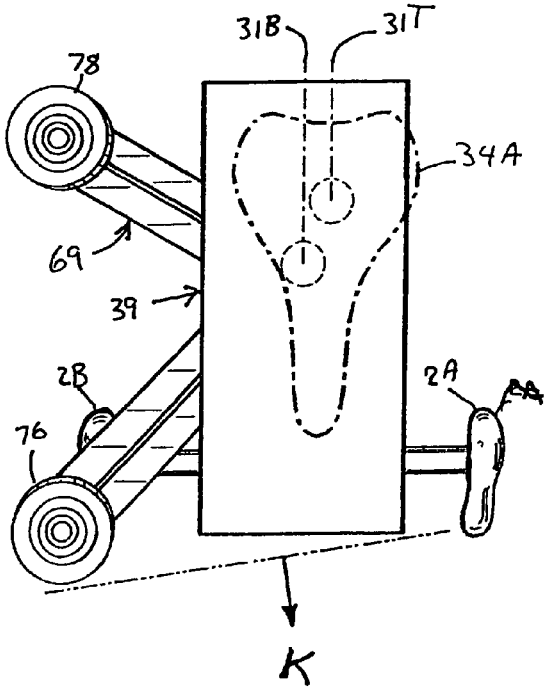

FIG. 25 is a bottom view of left injured limb offset frame assembly 66 looking from the bottom of foot assembly 39. The arrow at K shows the direction of the assembly 66 at the end of a step. That is, because of the forward position of the front stabilizer post tip 76, the movement of the assembly in the direction of the arrow K tends to shift the weight of a person to the residual limb. The offset support tube top 31T and bottom 31B are shown in the same offset position as in FIG. 22.

Figure 26:
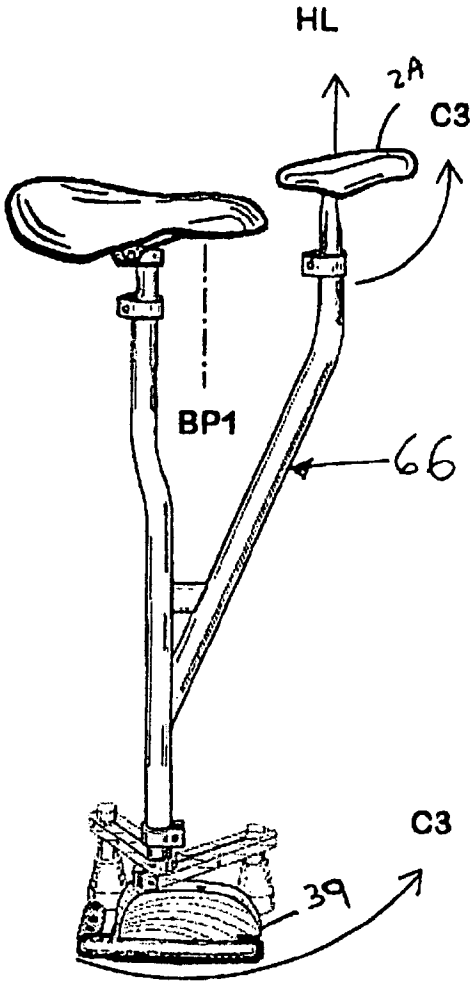
FIG. 26 is a right side elevational view of the invention in accordance with a preferred embodiment.

FIG. 26 is a right side elevational view of a left injured limb offset frame assembly 66. Arrow HL represents handle lift direction. The arrow at C3 represents the rotation of the assembly 66 about the T bar handle right end 2A and left end 2B. BP1 represents the balance point of the assembly 66 forward and aft. The arrow at C4 represents the arc of the foot assembly 39 as the assembly is advanced by the user.

Figure 27:
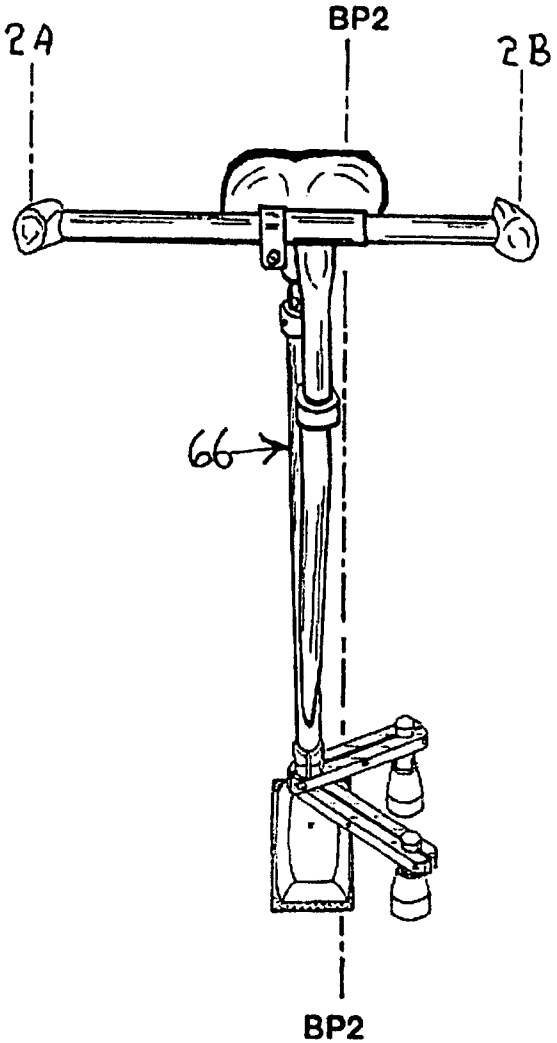
FIG. 27 is a front elevational view thereof.

FIG. 27 is a front elevational view of left injured limb offset frame assembly 66 showing the lateral balance point BP2. It should be recognized that the T bar handle left end 2B is closer to BP2 than T bar handle right end 2A making the handle lift equal on each side causing left injured limb offset frame assembly 66 to pivot as in FIG. 26. This tends to equalize the lifting in the hands, considering that the equalizer is added to one side. It also allows for better body positioning on the sound side giving the person better body alignment and balance.

Figure 28:
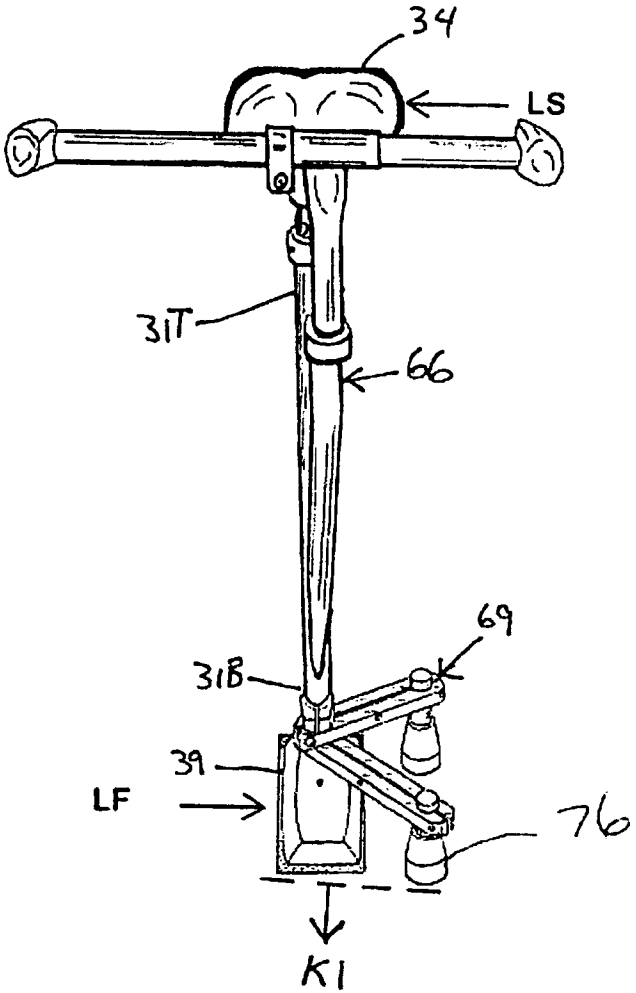
FIG. 28 is a front elevational view thereof with a different adjusted position of the stabilizer portion thereof.

FIG. 28 is a front elevational view of left injured limb offset frame assembly 66. Arrow K1 shows the lateral direction the frame 66 travels at the end of a step which returns a person back to their sound side. This is a result of the front stabilizer post tip 76 being forward of leading edge of foot assembly 39. Arrow LS shows the offset position of saddle 34 over the foot assembly 39.

Figure 29:
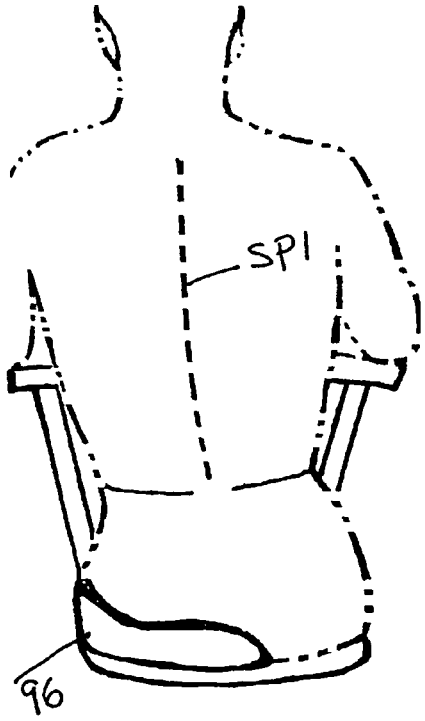
FIGS. 29-32 show various features of the present invention as used with a pelvic leveler seat.

FIG. 29 shows a phantom hemipelvectomy with SP1 showing the spine with little curvature as a result of using a pelvic leveler seat 96.

Figure 30:
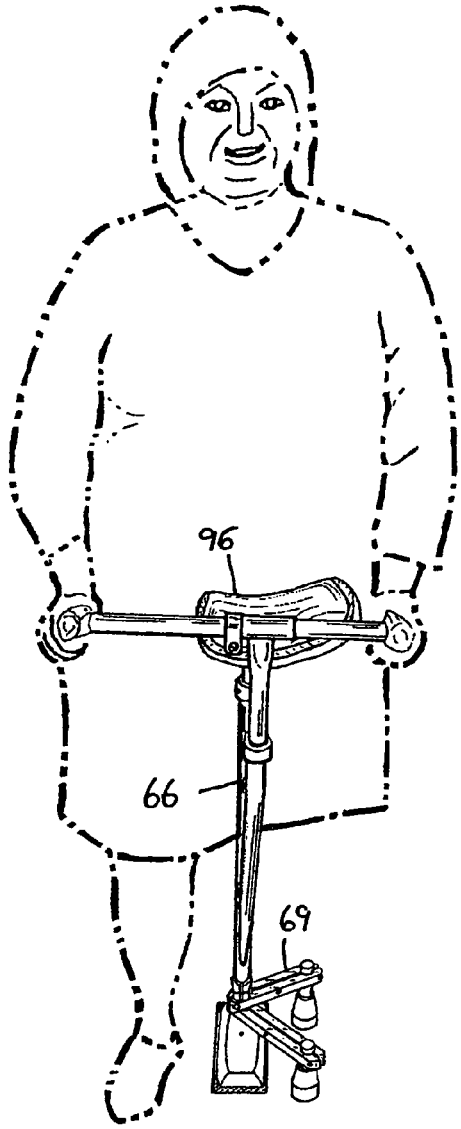

FIG. 30 shows a phantom hemipelvectomy resting upon left injured limb offset frame assembly 66 with a pelvic leveler seat 96.

Figure 31:
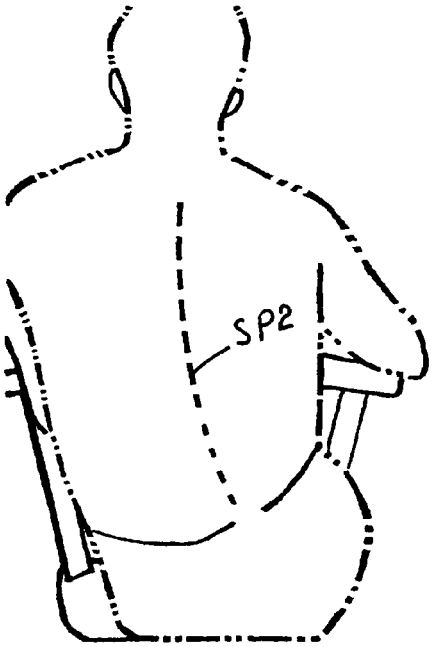

FIG. 31 is a phantom hemipelvectomy showing SP2 with considerable curvature.

Figure 32:
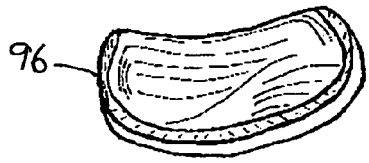

FIG. 32 is a perspective and mostly top view of a pelvic leveler seat 96.

I claim:

1. An orthopedic device adapted to support the body of a person having an injured or missing lower limb portion, comprising:

a frame member adapted to be oriented in a generally vertical disposition and having front and rear members;

said rear member having top and bottom ends and said front member having a top end;

said rear member having a seat attached to its top end and having a foot assembly attached to its bottom end said foot assembly being adapted to selectively engage a base surface; and an elongate handlebar having left and right handles attached to its ends, said handlebar being adjustably attached by an attachment mechanism to said front member top end such that the distance between said attachment mechanism and said respective right and left handles can be varied as necessary to fit the needs of the user.

2. An orthopedic device as set forth in claim 1 wherein said right handle is closer to said attachment mechanism then said left handle to accommodate a person with an injured/missing lower right limb.

3. An orthopedic device as set forth in claim 1 wherein said left handle is closer to said attachment mechanism then said right handle to accommodate a person with an injured/missing lower left limb.

4. An orthopedic device as set forth in claim 1 wherein said front and rear members are integrally connected.

5. An orthopedic device as set forth in claim 1 wherein said attachment mechanism comprises at least one clamp member having an adjustably sized opening with the handlebar passing therethrough.

6. An orthopedic device as set forth in claim 5 wherein said attachment mechanism includes an extension member having a vertical portion attached to said front member top end and a horizontal portion attached to a top end of said vertical portion, and further wherein said clamp member includes a second adjustably sized opening with the horizontal portion passing therethrough.

7. An orthopedic device as set forth in claim 6 and including a pair of spaced clamps with each having a pair of spaced holes with the respective handlebar and horizontal potion passing therethrough.

8. An orthopedic device as set forth in claim 1 and including a stabilizer mechanism that is attached to said frame rear member near said rear member bottom end and extending laterally outwardly in the direction of the missing lower limb portion, said stabilizer having a leg portion which is adapted to selectively engage a base surface along with said foot assembly.

9. An orthopedic device as set forth in claim 8 wherein said stabilizer mechanism includes a pair of laterally extending members with each having a leg portion associated with the respective front and rear ends of the foot assembly.

10. An orthopedic device as set forth in claim 9 wherein the leg of one of said pairs of laterally extending members is disposed in a plane forward of a plane of a rear edge of the foot assembly.

11. An orthopedic device as set forth in claim 9 wherein the leg of one of said pair of laterally extending members is disposed in a plane that is forward of a plane of a forward edge of the foot assembly.

12. A method of selectively adapting an orthopedic device to support the body of a person having an injured or missing lower limb portion in either of the right or left limb, respectively, comprising the steps of:

providing a frame member adapted to be oriented in a generally vertical disposition and having front and rear members, said rear member having top and bottom ends and said front member having a top end, and said rear member having a seat attached to its top end and having a foot assembly attached to its bottom end said foot assembly being adapted to selectively engage a base surface; and selectively adjusting the relative positions of the seat and the foot assembly such that, the seat is laterally offset from the foot assembly in a direction opposite from the side of the injured/missing lower limb portion.

13. A method as set forth in claim 12 wherein the adjustment process includes the step of orienting the frame member such that the respective positions of the rear member top and bottom ends are laterally offset and further wherein said rear member bottom end is laterally offset from said rear member top end toward the side of the missing lower limb portion.

14. A method as set forth in claim 12 wherein said selective adjustment process includes the step of providing one or more templates that are designed to represent the needs of a particular user, with said one or more templates being used to selectively engage portions of the frame member to accommodate the desired orientation thereof.

15. A method as set forth in claim 12 and including the step of providing a stabilizer mechanism attached to said frame rear member near said rear member bottom end and extending laterally outwardly therefrom in the direction of the injured/missing lower limb portion, said stabilizer mechanism having a leg portion that is adapted to engage a base surface along with said foot assembly.

16. A method as set forth in claim 15 wherein said stabilizer mechanism includes a pair of laterally extending members with each having a leg portion that is associated with a front or rear edge of the foot assembly.

17. A method as set forth in claim 16 wherein said leg portion associated with said foot assembly front edge is aligned in a plane that is disposed forwardly of the plane of the front edge of the foot assembly.

18. An orthopedic device adapted to support the body of a person having an injured or missing lower limb portion, comprising:

a frame member adapted to be oriented in a generally vertical disposition and having front and rear members;

said rear member having top and bottom ends and said front member having a top end;

said rear member having a seat attached to its top end and having a foot assembly attached to its bottom end said foot assembly being adapted to selectively engage a base surface; and a stabilizer mechanism that is attached to said rear member near said rear member bottom end and extending laterally outwardly, in the direction of the injured/missing lower limb portion, said stabilizer having a leg portion which is adapted to selectively engage a base surface along with said foot assembly.

19. An orthopedic device as set forth in claim 18 wherein said stabilizer mechanism includes a pair of laterally extending members with each having a leg portion associated with the respective front and rear ends of the foot assembly.

20. An orthopedic device as set forth in claim 19 wherein the leg of one of said pairs of laterally extending members is disposed in a plane forward of a plane of a rear edge of the foot assembly.

21. An orthopedic device as set forth in claim 19 wherein the leg of one of said pair of laterally extending members is disposed in a plane that is forward of a plane of a forward edge of the foot assembly.

* * * * *